US011028990B2

(12) United States Patent
Renaud et al.

(10) Patent No.: US 11,028,990 B2
(45) Date of Patent: Jun. 8, 2021

(54) SINGLE-PIECE OPTICAL MOTOR-VEHICLE PART COMPRISING A STRUCTURAL MODIFICATION

(71) Applicant: VALEO VISION, Bobigny (FR)

(72) Inventors: Pierre Renaud, Bobigny (FR); Alexandre Joerg, Bobigny (FR); Francois Gratecap, Bobigny (FR); Yves Gromfeld, Bobigny (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 16/562,804

(22) Filed: Sep. 6, 2019

(65) Prior Publication Data

US 2020/0080699 A1 Mar. 12, 2020

(30) Foreign Application Priority Data

Sep. 7, 2018 (FR) ..... 18 58047

(51) Int. Cl.
*F21S 41/24* (2018.01)
*F21S 41/25* (2018.01)

(52) U.S. Cl.
CPC ..... *F21S 41/24* (2018.01); *F21S 41/25* (2018.01)

(58) Field of Classification Search
CPC ..... F21S 41/24; F21S 41/25
See application file for complete search history.

(56) References Cited

U.S. PATENT DOCUMENTS

2014/0133168 A1 5/2014 Fiederling et al.

FOREIGN PATENT DOCUMENTS

| | | | |
|---|---|---|---|
| DE | 10 2010 044 424 | A1 | 3/2012 |
| DE | 10 2017 002 394 | A1 | 12/2017 |
| EP | 2 587 125 | A2 | 5/2013 |
| EP | 2 998 645 | A2 | 3/2016 |
| EP | 3 208 527 | A1 | 8/2017 |
| JP | 2016-212962 | A | 12/2016 |

OTHER PUBLICATIONS

French Preliminary Search Report dated Jun. 28, 2019 in French Application 18 58047, filed on Sep. 7, 2018 (with English translation of categories of Cited Documents).
European Office Action dated Jan. 29, 2021, in European Application No. 19 194 764.7, 7 pages.

*Primary Examiner* — Thomas M Sember
(74) *Attorney, Agent, or Firm* — Oblon, McClelland, Maier & Neustadt, L.L.P.

(57) ABSTRACT

A single-piece optical vehicle part comprising: a plurality of entrance dioptric interfaces and/or a plurality of exit dioptric interfaces; at least one junction between two adjacent entrance dioptric interfaces and/or at least one junction between two adjacent exit dioptric interfaces. The junction between two adjacent entrance dioptric interfaces and/or the junction between two adjacent exit dioptric interfaces has a structural modification allowing light to be absorbed and/or scattered.

20 Claims, 6 Drawing Sheets

SINGLE-PIECE OPTICAL MOTOR-VEHICLE PART COMPRISING A STRUCTURAL MODIFICATION

The present invention relates to an optical part intended to be mounted in a motor-vehicle lighting device. Particularly, the invention relates to an optical part that is placed in front of one or more light sources in order to propagate the light rays emitted by said one or more sources. More particularly, the invention relates to an optical part comprising a plurality of entrance dioptric interfaces and/or a plurality of exit dioptric interfaces.

As known, optical modules able to generate a pixel beam the projection of which forms an image composed of pixels already exist. Said pixels are organized into at least one horizontal and/or vertical row and each of the pixels may be selectively activated.

Such an optical module is used in addition to a second optical module able to generate a main lighting and signalling beam in order to form a lighting and signalling beam incorporating an adaptive function.

By way of example, in the case of a low beam, the pixel beam is turned on with a bottom segment of the low beam in order to produce an additional lighting function, namely a dynamic bending light (DEL). This function allows the inside of the corner that the vehicle is being driven round or entering to be illuminated.

In another example, the pixel beam is turned on with a segment of high beam in order to produce an adaptive driving beam (ADB) the aim of which is to provide the driver of the vehicle with better visibility while preventing the driver of an oncoming vehicle from being subjected to glare.

Simply put, the optical module able to generate a pixel beam comprises a plurality of elementary light sources that are selectively activatable and arranged in a matrix array of elementary light sources, and an optical part that is placed in front of said matrix array and that projects a light beam forwards.

The optical part comprises light guides that are on the whole arranged in parallel directions, and one entrance dioptric interface and/or one exit per guide. The number of guides corresponds to the number of elementary light sources. Alternatively, the number of guides is higher than the number of elementary light sources.

Generally, the elementary light sources may be light-emitting diodes (LEDs).

For each light guide, the entrance dioptric interface is placed at one end of said guide so as to form the entrance for light through which light rays pass to enter into the guide. Each entrance dioptric interface is placed facing one elementary light source.

The exit is placed at another end of the guide and thus forms an exit for the light rays.

The exits of the guides are imaged by one or more projecting optics so as to form a pixel beam.

In this case, the pixels correspond to the exits of the light guides.

However, it has been observed that the current configuration of the optical part comprising the light guides occasions the presence of parasitic light rays.

In the context of the present invention, by parasitic light rays what is meant is rays that are output by a first light source placed facing a first entrance dioptric interface, but that end up in the neighbouring guides located on either side of said first entrance dioptric interface. These rays then propagate through a guide that is not intended therefor.

Light rays that propagate into a first light guide and that exit through the exit dioptric interfaces of other light guides located on either side of said first guide are also considered to be parasitic light rays.

Parasitic rays may be recognized in the image projected by the optical module. Specifically, because of the parasitic rays, the outside edges of the pixels do not have the expected shapes and the beam comprises luminous regions of extra brightness, this degrading the quality of the pixel beam.

The technical problem that the invention aims to solve is therefore that of providing a more precise pixel beam that achieves lighting of good quality.

To this end, a first subject of the invention is a single-piece optical vehicle part comprising:

- a plurality of entrance dioptric interfaces and/or a plurality of exit dioptric interfaces;
- at least one junction between two adjacent entrance dioptric interfaces and/or at least one junction between two adjacent exit dioptric interfaces.

According to the invention, the junction between two adjacent entrance dioptric interfaces and/or the junction between two adjacent exit dioptric interfaces has at least one structural modification allowing light to be absorbed and/or scattered.

In this way, the structural modification plays the role of a barrier that scatters and/or absorbs the parasitic light rays. In particular, by virtue of the structural modification, the light rays of a first elementary light source, located facing a first entrance dioptric interface, are absorbed or scattered at the junction between this first entrance dioptric interface and an adjacent entrance dioptric interface. Therefore, far fewer light rays output from the first light source can propagate through the guide there beside.

In a case where the light guides are followed by exit dioptric interfaces, the exit dioptric interface located downstream of a first light guide is called the first exit dioptric interface and the exit dioptric interface that is located downstream of a second light guide placed beside the first guide is called the second exit dioptric interface.

Just as for the entrance dioptric interfaces, by virtue of the structural modification present at the junction between the first exit dioptric interface and the second exit dioptric interface, light rays propagating through the first light guide are absorbed or scattered at said junction.

Both in the case of entrance dioptric interfaces and in the case of exit dioptric interfaces, the structural modification at the junction between the adjacent dioptric interfaces allows either the light intensity of the image of the parasitic rays formed by the optical part to be decreased, or the formation of the image of the parasitic rays by the exit dioptric interface that precedes the neighbouring light guide to be prevented.

Therefore, by virtue of the structural modification, the risk of delivering excess light intensity to the pixel is decreased. Therefore, the lighting device bearing the optical part will not be penalized during approval.

Thus, by virtue of the optical part according to the invention, the optical module bearing said part generates a clear and precise light beam while respecting the conditions of regulations.

The optical part according to the invention may optionally have one or more of the following features:

- only the junctions between the adjacent entrance dioptric interfaces have the structural modification; in certain models of the optical part, the parasitic light rays are more present at the junctions between the adjacent entrance dioptric interfaces; thus, the precision of the pixels is improved by introducing the structural modification at said junctions so as to prevent or scatter parasitic light rays;

only the junctions between the adjacent exit dioptric interfaces have the structural modification; thus, in certain models of the optical part, the parasitic rays are more present at the exit dioptric interfaces; the structural modification is therefore produced in the place where there is the highest probability of deviation of the light rays toward the adjacent exit dioptric interfaces;

the one or more junctions between two dioptric interfaces form a line of separation of the two corresponding dioptric interfaces, the structural modification being arranged along this line of separation; it is here a question of one embodiment of the entrance dioptric interfaces and/or of the exit dioptric interfaces, to which embodiment the invention is applied;

according to the preceding paragraph, the structural modification, arranged along the line of separation, extends depthwise into the material of the optical part; thus, the effectiveness of the structural modification is further improved at depth in the optical part;

the entrance dioptric interfaces and/or the exit dioptric interfaces are spaced apart from one another so that a gap separates the adjacent entrance dioptric interfaces and/or the adjacent exit dioptric interfaces, the gap comprising walls that together form the junction between the dioptric interfaces that it separates; it is here a question of another embodiment of the entrance dioptric interfaces and/or exit dioptric interfaces, to which embodiment the invention may be applied;

according to the preceding paragraph, at least one structural modification is produced in the gap between the adjacent entrance dioptric interfaces and/or between the adjacent exit dioptric interfaces; in addition, the structural modification is located at the bottom of the gap; the applicant has observed, in the configuration in which the adjacent dioptric interfaces are separated by a gap, parasitic light rays pass through the bottom of the gap in order to enter into the adjacent guide; thus, to prevent or decrease parasitic rays, the structural modification is produced at the bottom of the gap;

at least one structural modification is produced in the gap between the adjacent entrance dioptric interfaces, and in addition, the structural modification is located as close as possible to the adjacent entrance dioptric interfaces; the applicant has also observed that light rays have a tendency to propagate into the adjacent guide by passing through a portion of the gap which is located closest to the entrance dioptric interfaces;

at least one structural modification is produced in the gap between the adjacent exit dioptric interfaces, and in addition the structural modification is located as close as possible to the adjacent exit dioptric interfaces;

the junction between two adjacent entrance dioptric interfaces and/or the junction between two adjacent exit dioptric interfaces has a total area, called the total junction area; in addition, said structural modification partially occupies the total junction area of the junction in question; by way of example, in the case where the junction is composed of the walls of the gap, the total area of the junction is the area of these walls; thus, one portion of the area of these walls is modified structurally so as to scatter and/or absorb the parasitic rays on contact;

the structural modification is produced by laser; by way of example, the laser may be a YAG laser or fibre laser; in this case, the optical part must be made of a material compatible with the laser, i.e. from a material that converts under the excitation of the laser so as to scatter and/or absorb the light rays;

the structural modification is produced by graining; by way of example, the optical part is produced from a polymer and the graining may be carried out during the step of moulding the optical part;

the structural modification is produced by depositing a reflective, absorbent and/or scattering coating.

Unless otherwise indicated, the terms "front", "rear", "lower", "upper", "top", "bottom", "side", "right", "left", refer to the direction of emission of light out of the corresponding optical part. Unless otherwise indicated, the terms "upstream" and "downstream" refer to the direction of propagation of the light in the object to which they relate.

Moreover, the terms "horizontal", "vertical" or "transverse" are defined with respect to the orientation with which the optical part is intended to be fitted in the vehicle. In particular, in this patent application, the term "vertical" designates an orientation perpendicular to the plane of the horizon whereas the term "horizontal" designates an orientation parallel to the plane of the horizon.

Other features and advantages of the invention will become apparent on reading the detailed description of the nonlimiting examples that follow, for the comprehension of which the reader is referred to the appended drawings, in which.

Figure 1:
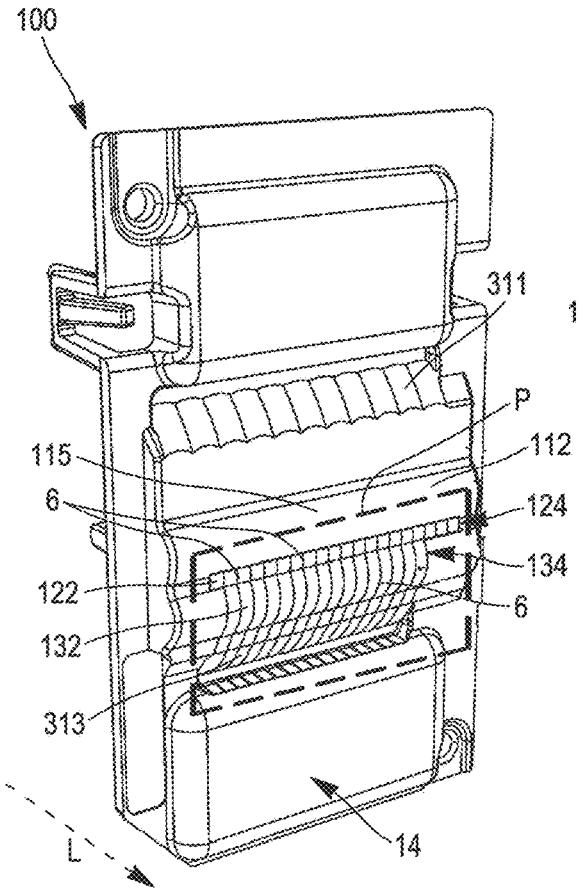
FIG. 1 illustrates a perspective view of a single-piece optical part according to a first embodiment, said view showing a front face of the optical part.
Figure 2:
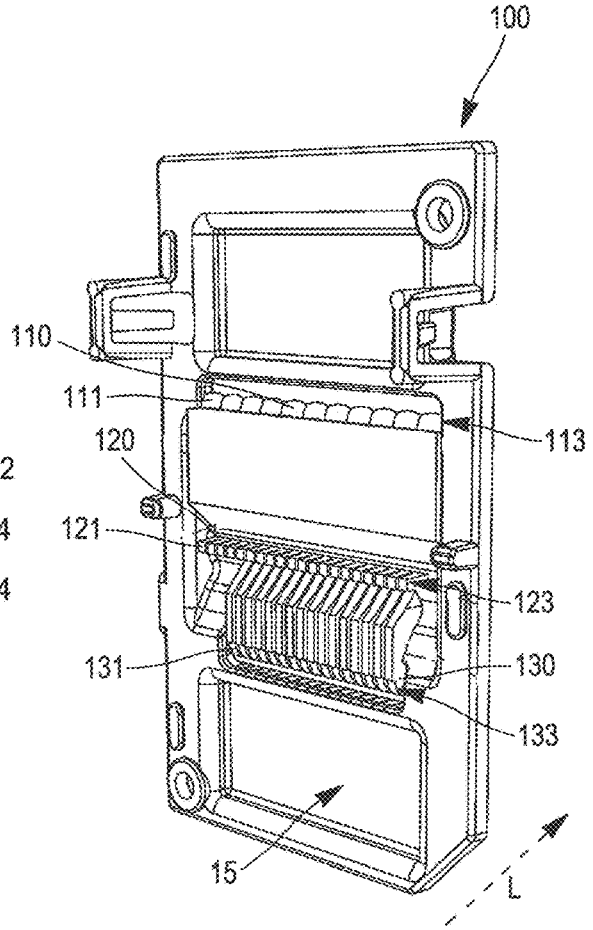
FIG. 2 illustrates another perspective view of the optical part of FIG. 1, showing a rear face of the optical part.

With reference to FIG. 1 and to FIG. 2, the optical part 100 according to a first embodiment comprises three rows of optical elements, namely a first row 11, a second row 12 and a third row 13 of optical elements. Each row comprises juxtaposed light guides and lenses.

In the rest of the description, the optical elements of the first row 11 are also called the first optical elements 11. The optical elements of the second row 12 are also called the second optical elements 12. The same goes for the optical elements of the third row 13, which are also called the third optical elements 13.

The optical part 100 composed of these three rows 11, 12 and 13 of optical elements is produced in a single part, hence the name "single-piece optical part".

The first row 11 of optical elements comprises first light guides 110 and a first lens 115.

Each first light guide 110 comprises an entrance face and an exit. The entrance face forms a first entrance dioptric interface 111.

The first lens 115 extends laterally so as to cover the exits of the first light guides 110. In addition, the first lens 115 is arranged so that the exits of the first light guides 110 are coplanar with the focal plane of said first lens 115.

The first lens 115 has a curved surface 116. In the illustrated example, the curved surface 116 is convex toward the front and arranged so that it forms a first exit dioptric interface 112 of the first optical element 11. Optionally, the curved surface 116 may be the shape of a segment of a sphere, i.e. curved toward the front horizontally and vertically, so as to spread the beam generated by the first optical element 11.

The first entrance dioptric interfaces 111 are placed in contact beside one another so as to form a transverse row 113 of first entrance dioptric interfaces 111.

In the illustrated example, the first light guides 110 and the first lens 115 form a single part. It will be noted here that the light guides do not separate from one another between the first entrance dioptric interfaces 111 and the exit dioptric interface of the lens 115.

In the second row, each second optical element 12 comprises a second guide 120 followed by a second lens 125. The second guide 120 extends longitudinally from the rear to the front along the optical axis L of the optical part 100. Each second guide 120 comprises an entrance face and an exit. The entrance face forms a second entrance dioptric interface 121.

Unlike the first optical element 11, the second optical element comprises one lens per guide. Each second lens 125 also comprises a curved surface 126.

Each second lens 125 is placed downstream of the corresponding second guide 120 so that the exit of said guide is in the focal plane of said lens. The curved surface 126 of the second lens 125 is oriented toward the front so as to form a second exit dioptric interface 122.

The second exit dioptric interfaces 122 are placed in contact side-by-side.

The third row 13 of optical elements has the same configuration as the first row 11 of optical elements.

Each third optical element 13 comprises a third light guide 130 and a third lens 135.

Each third light guide 13 comprises an entrance face forming a third entrance dioptric interface 131 and an exit placed in a focal plane of the corresponding third lens 135.

As for each third lens 135, it comprises a curved surface 136 oriented toward the front so as to form a third exit dioptric interface 132.

The third entrance dioptric interfaces 131 are placed in contact beside one another so as to form a transverse row 133 of third entrance dioptric interfaces. In the same way, the third exit dioptric interfaces 132 are placed in contact beside one another so as to form a transverse row 134 of third exit dioptric interfaces.

Whatever the row, the entrance dioptric interfaces are visible on the back face 15 of the optical part 100 whereas the exit dioptric interfaces are visible on the front face 14 of the optical part 100.

The particularity of the first optical elements 11 is that the first light guides 110 extend vertically so as to have the row 113 of the first entrance dioptric interfaces 111 and the first exit dioptric interface 112 at two different levels. Here, the row 113 of the first entrance dioptric interfaces 111 is placed above the first exit dioptric interface 112.

The third optical elements 13 also comprise the third light guides 130, which extend vertically. The row 133 of the third entrance dioptric interfaces 131 and the row 134 of the third exit dioptric interfaces 132 are at two different levels. Here, the row 133 of the third entrance dioptric interfaces 131 is placed below the row 134 of the third exit dioptric interfaces 132.

For each of the second optical elements 120, the entrance dioptric interface 121 is at the same level as the exit dioptric interface 122.

The single-piece optical part 100 is placed in front of the light-emitting means that are, here, composed of a plurality of elementary light sources 3. By way of example, the elementary light source 3 is a light-emitting diode (also called an LED).

In the illustrated example, the elementary light sources 3 are arranged in a plurality of transverse rows. The number of rows of elementary light sources corresponds to the number of rows of light guides, which are three in number here.

The optical part 100 is positioned with respect to the emitting means so that each row 113, 123, 133 of entrance dioptric interfaces 111, 121, 131 is placed facing a row of elementary light sources 3.

Figure 4:
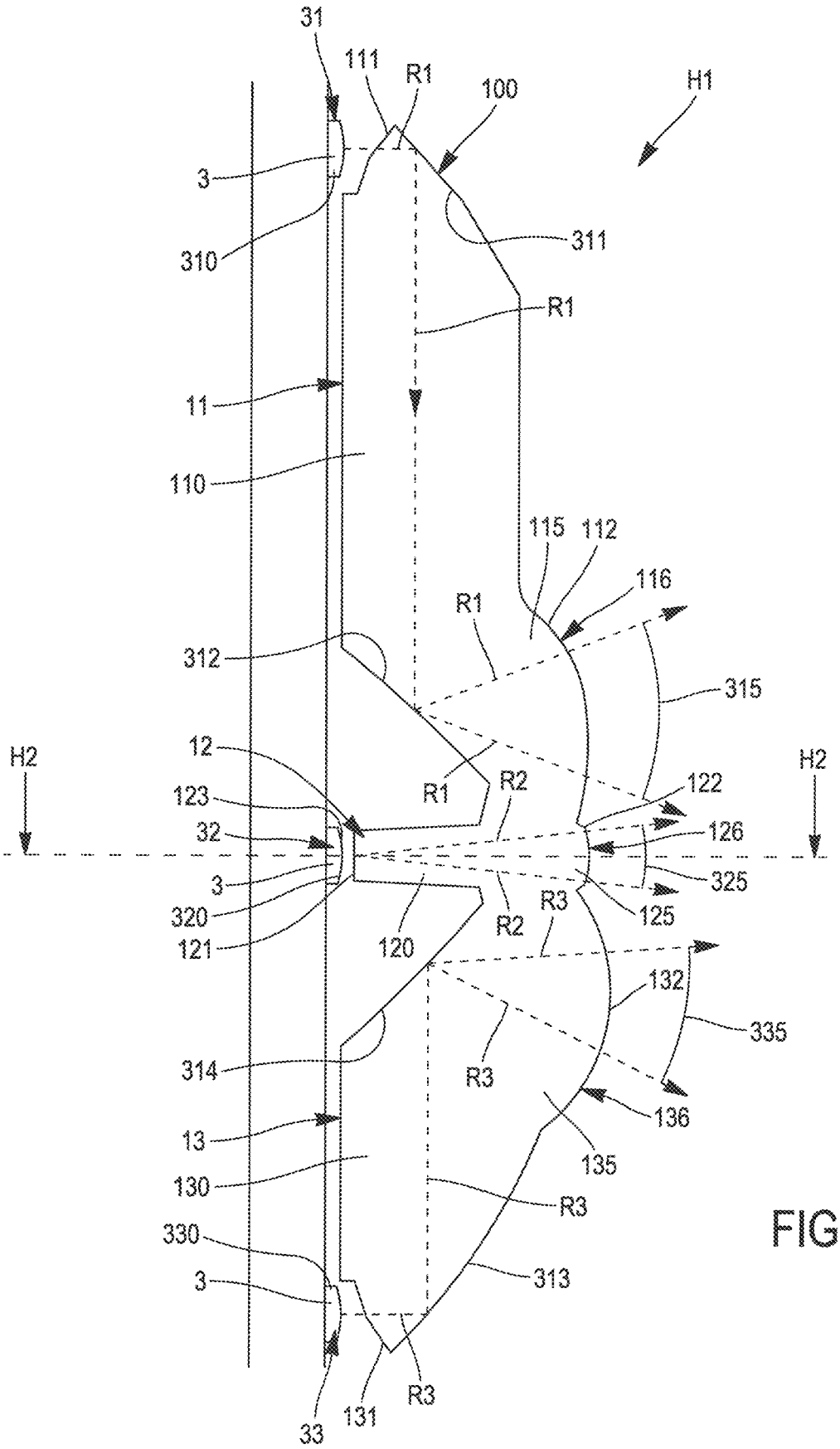
FIG. 4 illustrates a schematic cross section in a plane H1 illustrated in FIG. 3, which shows the path of the light rays output from various light sources.

More precisely, as illustrated in FIG. 4, each first entrance dioptric interface 111 is directly opposite one elementary light source 3 of a first row 31 of elementary light sources. Likewise, each second entrance dioptric interface 121 is directly opposite one elementary light source 3 of a second row 32 of elementary light sources. Lastly, each third entrance dioptric interface 131 is directly opposite one elementary light source 3 of a third row 33 of elementary light sources.

For ease of reading, the elementary light sources forming part of the first row of sources will also be called the first elementary light sources 310. The same goes for the light sources of the second row and of the third row, below respectively referenced 320 and 330.

FIG. 4 shows in detail the path of the light rays output from the elementary light sources 310, 320 and 330 in the optical part 100.

As regards the first elementary light sources 310, each first source 310 emits first rays R1 that enter into the optical part by the first entrance dioptric interface 111.

The first rays R1 are then reflected by a first reflecting surface 311 that is positioned facing the first entrance dioptric interface 111. Here, the first reflecting surface 311 is configured so as to collimate the first rays R1 and to direct them toward a second reflecting surface 312. After the second reflecting surface 312 has been reached, the reflected first rays R1 are directed longitudinally toward the first exit dioptric interface 112. The latter projects the first rays R1 forward in order to form a first beam 315.

The first beam 315 is projected by a projecting system (not illustrated in the figures). The image of the first unitary beam 315 has a shape corresponding to that of the first light sources 310. By way of example, the image of the first beam 315 forms a bottom low-beam portion.

The second light source 320 emits the second light rays R2 e.g. which pass through the second entrance dioptric interface 121 in order to enter into the optical part 100. The second entrance dioptric interface 121 is schematically represented by a plane for the sake of simplicity, but it is advantageously slightly convex so as to produce a relief in the direction of the second source 320.

Once inside the optical part 100, the second light rays R2 then propagate by total internal reflection until they reach the second exit dioptric interface 122. The latter thus projects forward the second light rays R2 so as to form a second unitary beam 325.

The second unitary beam 325 is projected by a projecting system (not illustrated in the figures). The image of the second unitary beam 325 comprises a pixel the shape of which corresponds to that of the second exit dioptric interface 122.

The third light source 330 emits third rays R3 that enter into the optical part via the third entrance dioptric interface 131. The third rays R3 are then reflected by a third reflecting surface 313 placed substantially at the same level as the third entrance dioptric interface 133.

The reflected third rays R3 are then directed upward and, here, toward a fourth reflecting surface 314 that steers them toward the third exit dioptric interface 132. The latter projects the third rays R3 forward so as to form a third unitary beam 335.

Here, the second and third rows of optical elements 12 and 13 are arranged so as to generate a pixel beam. A pixel beam contains a number of unitary beams each of which is produced by one elementary light source in conjunction with one optical element. The image of the unitary beam comprises one pixel.

Figure 5:
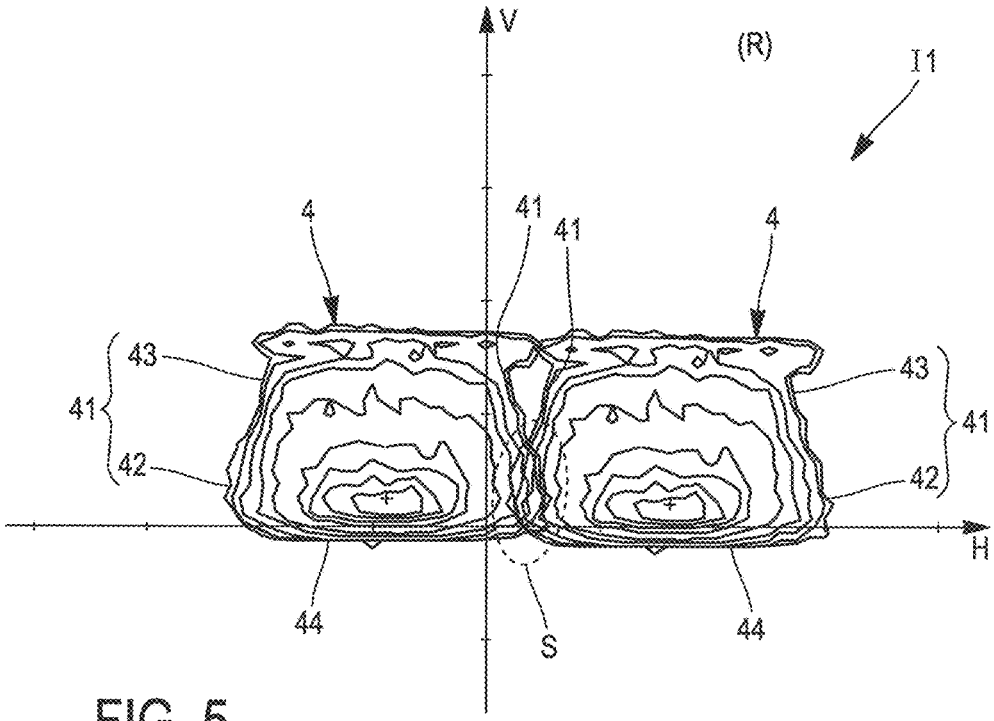
FIG. 5 illustrates the image of two pixels generated by a projection system that projects the image of the guide exits of the optical part of FIG. 1, said part comprising no structural modifications; said image is in the form of isolux curves at a distance of 25 metres in front of an optical module bearing the optical part of FIG. 1.

FIG. 5 illustrates, by way of example and schematically, a first image I1 of two unitary pixel beams 325 each generated using a second light source 320 and using a second optical element 12. The first image I1 is obtained by projecting the second beam onto a screen at 25 m.

The first image I1 is projected onto the screen in an orthogonal coordinate system R composed of a vertical ordinate axis V and of a horizontal abscissa axis H. The vertical axis V corresponds to a vertical axis above the road and the horizontal axis H symbolizes the horizon.

Here, the first image I1 comprises two pixels 4 of rectangular shape.

The applicant has observed that the general shape of the pixels 4 contains imperfections, in particular on the two lateral edges 41 of each pixel 4. Specifically, for each pixel 4, the two lateral edges 41 are not straight lines as expected. Each lateral edge 41 comprises a curved portion 43 followed by an inclined line 42 that joins a lower edge 44 of the pixel 4. This means that the pixel 4 has an irregular trapezium shape comprising a lateral protrusion.

This irregular shape has a disadvantageous effect on the pixel beam. Specifically, the pixels 4 are positioned one beside one another. Thus, in the case of a pixel such as illustrated in FIG. 5, the laterally protruding curved portion 43 overlaps with a laterally protruding curved portion 43 of a neighbouring pixel.

This therefore creates a zone of overlap S in which the light intensity is higher than it is inside each pixel 4. Therefore, a light beam with a nonuniform distribution of light is obtained, this decreasing the quality of the light beam.

The applicant has identified that the poor formation of the pixels is due to parasitic light rays. Specifically, in a given row of optical elements, a minority of the light rays that propagate through a light guide may enter into the neighbouring guide at the junction between two exit dioptric interfaces of these guides. The rays, which are thus said to be "lost" or "parasitic", exit via the exit dioptric interface of the neighbouring light guide. These parasitic rays form irregularities in the pixel imaged by the neighbouring light guide. The effect is applicable for each light guide and its neighbours to the left and to the right. The same goes for each row of optical elements.

To solve this problem, the applicant proposes, according to one example of the invention, a structural modification at the junction of the exit dioptric interfaces, when there is a risk of leakage of the light rays from one guide to another to reach the exit dioptric interface of the other guide.

According to the invention and in this example, the junction 6 between two adjacent exit dioptric interfaces 122 or 132 may form a line of separation 6 of said dioptric interfaces. The lines of separation 6 are visible on the front face 14 of the optical part 100 in FIG. 1.

In this example, the structural modification consists in heating the material of the line of separation 6 so as to change the nature of the material thereof.

In the illustrated example, the optical part 100 being formed from polycarbonate (PC), the junction 6 between two adjacent exit dioptric interfaces 122 or 132 is thus formed from this material.

Polycarbonate is known for its transparency. The junction 6 between two adjacent exit dioptric interfaces is therefore initially transparent.

Using a high-temperature heat source, the junction 6 is heated until there is a change in the composition of the material, here until the transparency of the junction 6 converts into an opaque and dark appearance, close to the colour black.

In this way, the junction 6 has a new aspect forming an opaque barrier that stops all the light rays making contact therewith.

This processing is also called blackening of the junction. During this processing, initially, gas escapes and the surface of the junction burns. Subsequently, the junction changes from the transparent colour to the black colour.

In the illustrated example, the processing is applied to all the junctions of the exit dioptric interfaces of the second and third rows of optical elements. Here, given that the second and third exit dioptric interfaces 122, 132 of the optical part have the same widthwise dimension, the junctions 6 between the adjacent exit dioptric interfaces are aligned.

Thus, it is enough to pass the heat source in a straight line in order to convert the nature of the material of all the junctions of the exit dioptric interfaces of the second and third rows of optical elements.

By way of example, the heat source used is a laser source, in particular an yttrium aluminium garnet (YAG) laser source of a wavelength of 1064 nm. A fibre laser source with a wavelength between 1050 nm and 1070 nm may also be used.

Figure 3:
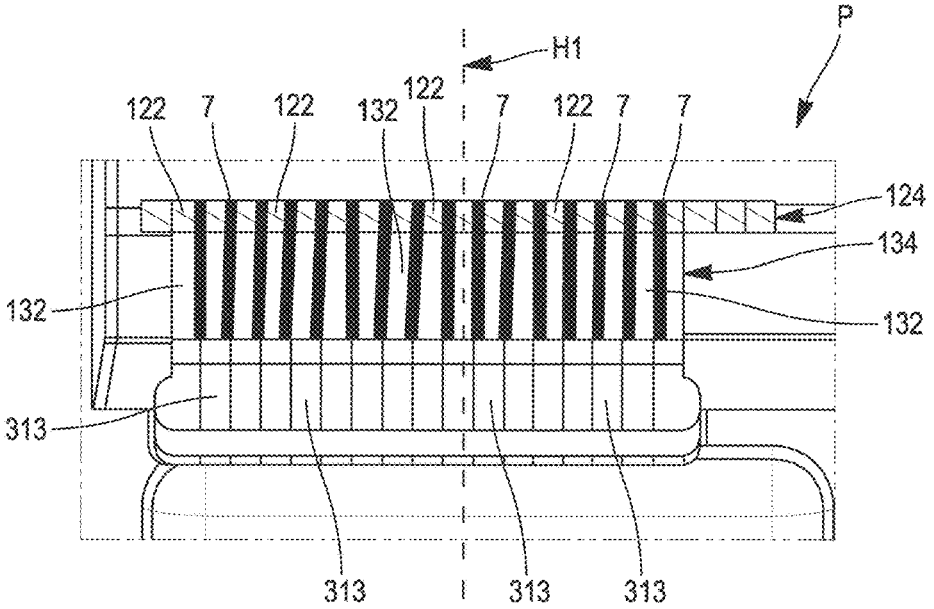
FIG. 3 illustrates a front view of details of the portion P (framed by the dashed box) of the front face of the optical part of FIG. 1, said view showing structural modifications of the optical part.

The structural modification of the junctions 6 between the second and third exit dioptric interfaces 122 or 132 has been represented by darklines 7 in FIG. 3.

Figure 6:
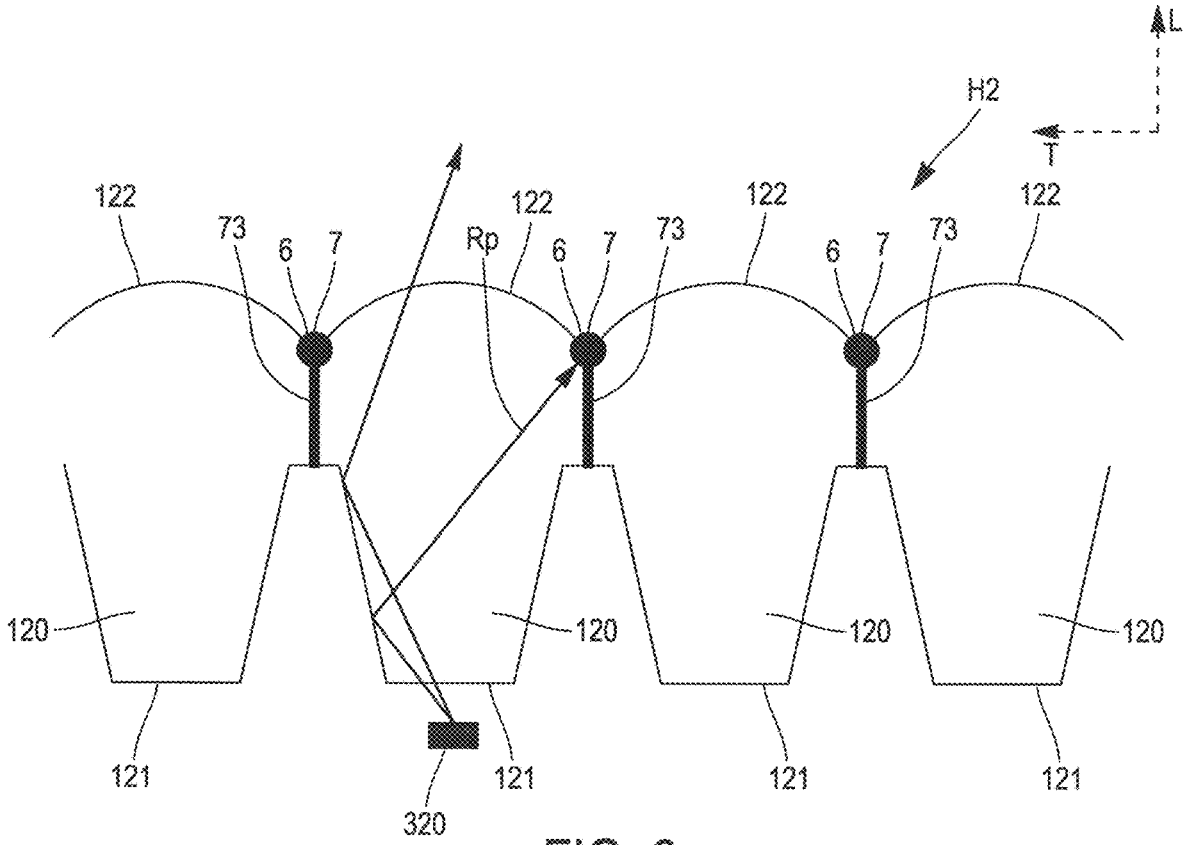
FIG. 6 illustrates a schematic cross section in a plane H2 illustrated in FIG. 4; said cross section shows a horizontal segment of the optical part of FIG. 1 comprising structural modifications.

In particular, the structural modification 7 of the junctions 6 between the second exit dioptric interfaces 122 may be seen in FIG. 6. Here, the structural modification 7 is produced at the junction 6 between two adjacent exit dioptric interfaces 122.

The duration of processing of the junction 6 is such that the structural modification 7, here the conversion to black colour of the material, extends depthwise into the material of the optical part 100 so as to form an opaque wall 73 inside the material. Here, the opaque wall 73 extends in the longitudinal direction L from the junction 6. The extent of the wall 73 in the longitudinal direction L depends on the duration of processing of the junction 6.

Thus, this opaque wall 73 absorbs any parasitic light ray Rp that has the tendency to propagate into the one or more guides that are not intended therefor. The structural modification significantly improves the quality of the projected image of the beam.

Figure 7:
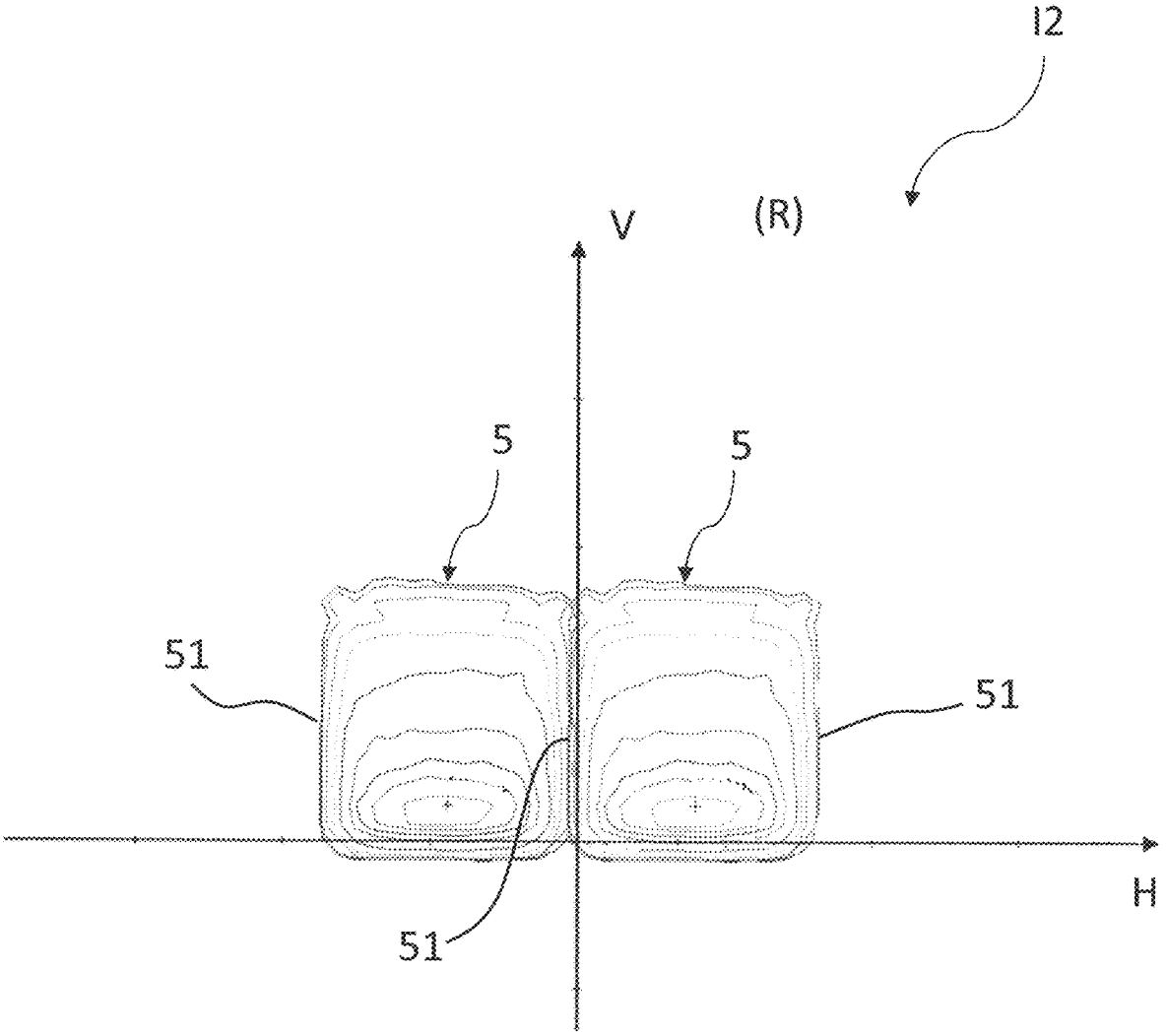
FIG. 7 illustrates the image of two pixels generated by a projecting system that projects the image of the guide exits of the optical part of FIG. 3, said part comprising structural modifications; said image is in the form of isolux curves at a distance of 25 metres in front of an optical module bearing the optical part of FIG. 3.

FIG. 7 illustrates a second image 12 showing pixels 5 generated using second exit dioptric interfaces 122 the junction 6 of which between two adjacent dioptric interfaces 122 comprises a structural modification 7 such as illustrated in FIG. 6. These pixels 5 now have a regular rectangular shape with straight lateral edges 51, this avoiding the overlap of pixels 5 juxtaposed side-by-side.

Thus, the pixel beam resulting from these unitary pixel beams has a uniform light-intensity distribution, the sign representative of a quality beam that procures a better visual comfort for users.

The structural modification such as described above could be applied to the first entrance dioptric interfaces 111 of the first row 113. Specifically, the first entrance dioptric interfaces 111 are placed in contact with one another. A line of separation is located between two adjacent first entrance dioptric interfaces 111. In other words, this line of separation forms a junction that separates two adjacent first entrance dioptric interfaces 111.

Figure 8:
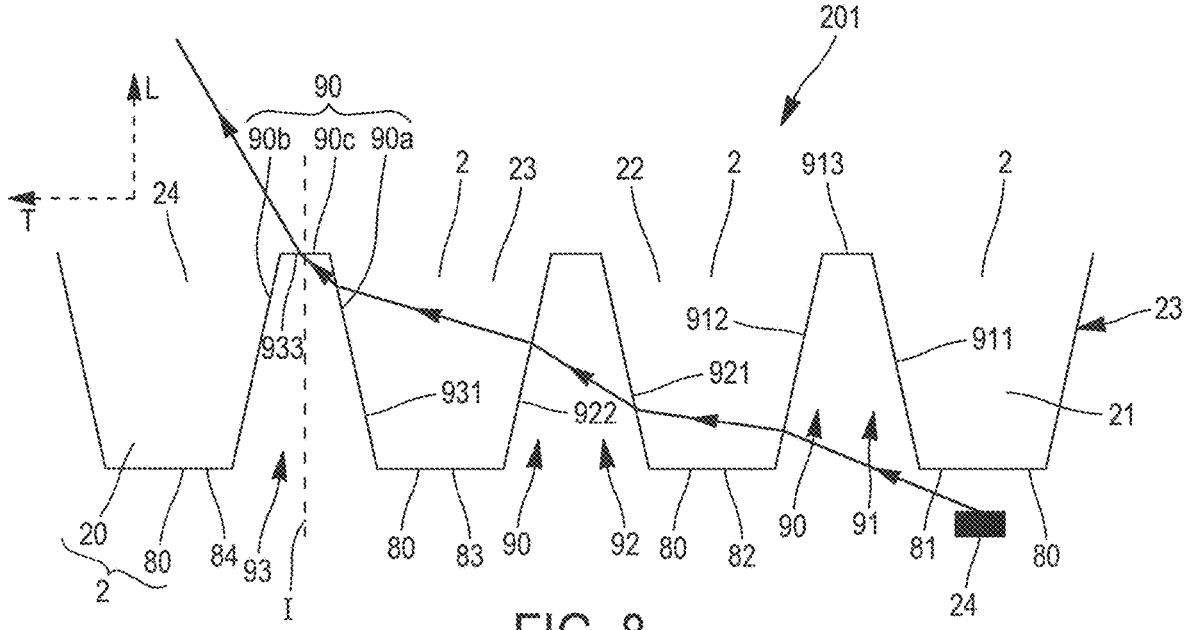
FIG. 8 illustrates a schematic view of a horizontal segment of a single-piece optical part having gaps between the adjacent entrance dioptric interfaces; said optical part does not comprise structural modifications.

FIG. 8 partially illustrates an optical part 201 having gaps between adjacent entrance dioptric interfaces. Here, the optical part 200 comprises a row 23 of juxtaposed optical elements 2.

Each optical element 2 comprises a light guide 20. Each light guide comprises an entrance face forming an entrance dioptric interface 80. Each entrance dioptric interface 80 is placed directly opposite a corresponding elementary light source 24 so that most of the light rays emitted by said light source pass through the entrance dioptric interface 80 in order to then propagate through the light guide 20.

The light propagates from the rear to the front along an optical axis L of the optical part 201, as illustrated by the arrow L in FIG. 8.

According to the invention and as in this example, the entrance dioptric interfaces 80 are spaced apart from each other so that a gap 90 separates the adjacent entrance dioptric interfaces 80. The gap 90 comprises walls that together form the junction 90 between the entrance dioptric interfaces 80 that it separates.

Here, the gap 90 comprises three walls, including a right lateral wall 90*a*, a left lateral wall 90*b* and a bottom wall 90*c*.

The bottom wall 90*c* is perpendicular to the direction of propagation of the light.

The lateral walls 90*a* and 90*c* here have mirror symmetry with respect to a main axis I of the gap. Here, the main axis I of the gap passes through the middle of the bottom wall 90*c* and is parallel to the direction of propagation of the light. In addition, the lateral walls are slightly inclined, oppositely, with respect to this main axis I.

In FIG. 8, only one light source 24 is shown. This light source 24 is placed facing a first entrance dioptric interface 81 followed by a first guide 21. The first entrance dioptric interface is spaced apart from its neighbouring entrance dioptric interface 82, which is also called the second entrance dioptric interface 82, by a first gap 91.

This first gap 91 comprises the right lateral wall 911 that connects the bottom wall 913 to the first entrance dioptric interface 81 and the left lateral wall 912 that connects the bottom wall 913 to the second entrance dioptric interface 82.

This structure is repeated for the other gaps of the same row.

The optical part 201, such as design, may occasion the presence of parasitic light rays.

Specifically, in the example of the light source 24 placed in front of the first entrance dioptric interface 81, i.e. the source illustrated in FIG. 8, a minority of the light rays of this source 24 may propagate through neighbouring guides close to the first light guide 21 by passing through the gaps.

FIG. 8 schematically illustrates one possible path of the parasitic light rays.

The parasitic ray, starting from the light source 24, initially travels so as to make contact with the left lateral wall 912 of the first gap 91, in a location located close to the second entrance dioptric interface 82. The parasitic ray then enters via refraction into the second light guide 22 that is the neighbour to the left of the first light guide 21.

The parasitic ray then propagates inside the second light guide in a lateral propagation direction T in order to then be directed toward the right lateral wall 921 of a second gap 92.

Here, the second gap 92 is that placed between the second entrance dioptric interface 82 and the entrance dioptric interface of a third guide 23 that is the neighbour to the left of the second guide 22. This entrance dioptric interface is also called the third entrance dioptric interface 83.

By exiting from the second light guide 22, then after having passed through the second gap 92, the parasitic ray enters into the third light guide 23 by passing through a left lateral wall 932 of the second gap 92, this lateral wall also forming the right lateral wall of the third guide 23.

In the third light guide 23, the parasitic ray continues to propagate laterally. It exits from the third light guide 23 by passing through the right lateral wall 931 of a third gap 93, that interposed between the third entrance dioptric interface 83 and a fourth entrance dioptric interface 84 of a fourth light guide 24.

Here, the parasitic ray makes contact with the wall of the bottom 933 of the third gap 93 and enters into the interior of the optical part 201 by refraction. Everything then occurs as though the wall of the bottom 933 were illuminated. Thus, the image of the illuminated wall of the bottom 933 is projected to infinity by the projecting system of the optical part.

The above description shows that certain light rays output from an elementary light source may not enter into the light guide that is associated therewith but propagate through neighbouring light guides by refraction by passing through the gaps separating the entrance dioptric interfaces of these guides. These light rays are therefore called parasitic light rays.

The propagation of the parasitic light rays may cause imperfections in the light beam generated by the optical part. These imperfections are in particular shown in FIG. 9, and may as here correspond to regions of extra brightness in zones that are already illuminated or may slightly illuminate zones that should be turned off.

Figure 9:
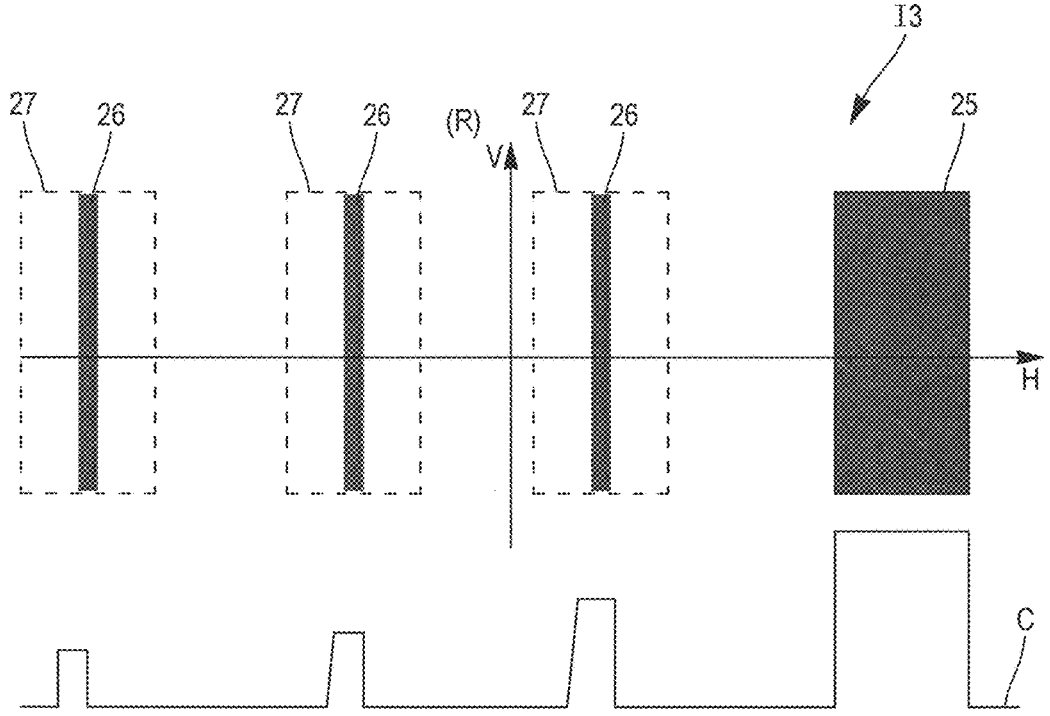
FIG. 9 illustrates the image of a luminous strip generated by the optical part of FIG. 8, and the zones illuminated by the parasitic light rays, and a curve of the corresponding variation in light intensity.

Specifically, FIG. 9 illustrates an image of a beam generated by the elementary light source and by the optical part shown in FIG. 8. This image is also called the third image 13.

The third image 13 is obtained on a vertical screen located at a distance from a luminous module containing the optical part 201, for example at 25 metres, and directly opposite said module.

The image 13 is projected onto the screen in an orthogonal coordinate system R composed of a vertical ordinate axis V and a horizontal abscissa axis H. The vertical axis V corresponds to a vertical axis above the road and the horizontal axis H symbolizes the horizon.

FIG. 9 also shows, below the image of the beam, the curve C of the variation in the light intensity along the horizontal axis H of the coordinate system R.

It may be seen that the image 13 of the beam comprises a pixel 25 of rectangular shape and imperfections, here three thin lines of light 26.

The lines of light 26 are formed by the parasitic light rays projected by the luminous module.

Specifically, the parasitic light rays propagate through the neighbouring guides and are imaged by a projecting optic in order to form one or more lines of light in the location where there is a pixel that belongs to the neighbouring guide.

The pixel 27 that belongs to the neighbouring guide, here the second, third and fourth light guides 22, 23 and 24, is illustrated by the dashed rectangles in FIG. 9.

Therefore, the one or more lines of light 26 add light intensity to that of the pixel 27 of the neighbouring guide.

In the case where the pixel 27 of the neighbouring guide is placed in a location where the light intensity must remain below a limiting value, the presence of the one or more lines of light 26 is undesirable, because it runs the risk of increasing the light intensity above the regulatory value and/or of generating a visual discomfort.

The probability of this situation occurring increases as the light intensity of the one or more lines of light 26 increases. Now, in the illustrated example, the curve C of the variation in the light intensity of the image indicates that the lines of light have a quite high light intensity. The lines of light 26 therefore deliver a surplus of light intensity to the pixels belonging to the neighbouring guides. Thus, the value of the light intensity, measured in the location where there is a superposition of the line of light 26 and the pixel 27, generates a visual discomfort, or even a risk that the set regulatory value will be exceeded.

Moreover, the presence of these lines of light prevents the pixels formed by the neighbouring light guides from being completely turned off. Specifically, when the light sources placed directly opposite the neighbouring guides, here the second, third and fourth light guides 22, 23, 24, are turned off, the corresponding pixels are also turned off. However, if the light source 24 located facing the first light guide 21 remains turned on, the parasitic rays remain. Thus, the lines of light 26 remain turned on in the location of the pixels of the neighbouring guides that are however turned off. It is therefore possible to have residual light that may subject an oncoming driver to glare.

To solve these problems in this example, the applicant proposes a structural modification at the junction of the entrance dioptric interfaces, according to one embodiment of the invention.

Here, it is a question of modifying the structure of the gap 90, 91, 92, 93 between the adjacent entrance dioptric interfaces 81, 82, 83 and 84. More precisely, a graining 70 is produced locally on at least one wall of the gap, as illustrated in FIG. 10.

In other words, if the walls forming the gap have a total area ST, the graining partially occupies this total area ST.

Figure 10:
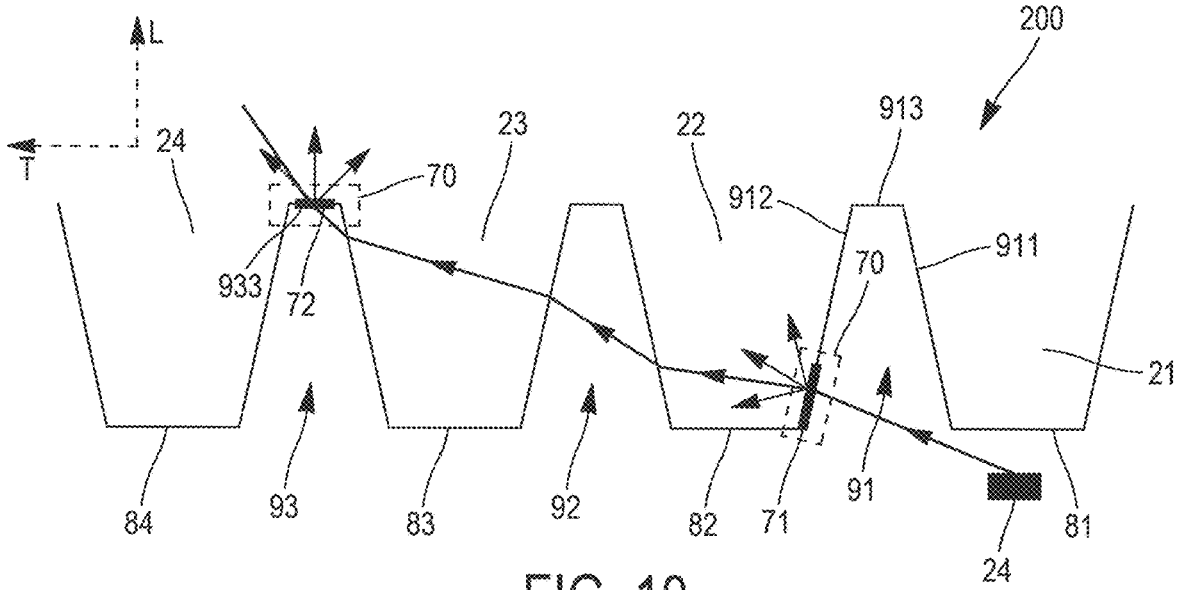
FIG. 10 illustrates a schematic view of a horizontal segment of a single-piece optical part having gaps between the entrance dioptric interfaces; said gaps comprising structural modifications according to a second embodiment of the invention.

As illustrated in FIG. 10, the graining 70 may be formed on the left lateral wall 912 of the first gap 91 and as close as possible to the second entrance dioptric interface 82. Here, it is a question of a first graining zone 71 that is illustrated by a bar encircled by dashed lines.

The longitudinal extent of the graining zone 71 depends on the configuration of the light guides and on the configuration of the entrance dioptric interfaces.

It will be noted that a graining zone similar to the first graining zone 71 could be produced in the gaps separating the entrance dioptric interfaces 121 of the second row 123 of the illustrated optical part 100 in the first embodiment.

In the embodiment of FIG. 10, there may also be a second graining zone 72 located in the wall of the bottom 933 of the third gap 93.

The graining is produced in cleverly chosen locations, for example, in the wall of the bottom or in the lateral wall and as close as possible to the entrance dioptric interface, because these locations are on the path very often traced by the parasitic light rays.

Depending on the configuration of the optical part, the graining may be produced locally in other locations through which the parasitic light rays pass.

Of course, the graining may be produced identically in the gaps in order to effectively scatter the parasitic light rays of all the elementary light sources.

By way of example, each gap may comprise graining on the wall of the bottom, and on a portion of the lateral walls that is located close to the entrance dioptric interfaces.

Figure 11:
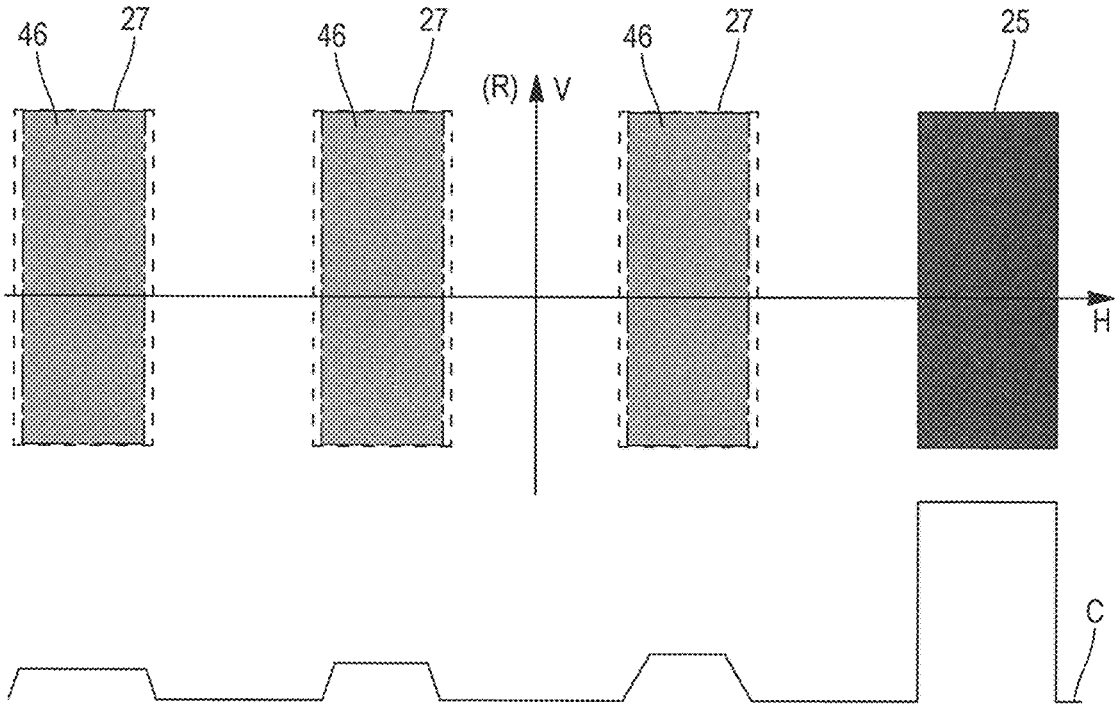
FIG. 11 illustrates the image of a luminous strip generated by the optical part of FIG. 10, the zones illuminated by the parasitic light rays, and a curve of the corresponding variation in light intensity.

FIG. 11 shows the advantageous technical effect achieved by the structural modification on the obtained pixel beam.

FIG. 11 illustrates an image 14 of the beam generated by the elementary light source and by the optical part 200 shown in FIG. 10. This image is also called the fourth image 14.

The image 14 is obtained under the same conditions as those of FIG. 9. It is shown in a coordinate system that is identical to the coordinate system of FIG. 9.

In FIG. 11, the image 14 comprises the pixel 25 corresponding to the elementary light source 24 and the strips of light 46 corresponding to the parasitic light rays.

In contrast, unlike FIG. 9, the strips of light 46 due to the parasitic light rays have a more extensive shape with a lower light intensity than that of the lines of light in FIG. 9.

Specifically, by virtue of the presence of the graining zones 71 and 72 in the gaps, the parasitic light rays are scattered on contact with said zones. This allows these strips of light 46 to be spread and the light intensity of the strips to be considerably decreased.

Therefore, the strips of light 46 output from the optical part 201 comprising the structural modifications 70, 71, 72 add a low or even negligible intensity to that of a pixel 27 corresponding to a neighbouring guide. Thus, the value of the light intensity, measured in the location where there is a superposition of the strip of light 46 and the pixel 27, improves visual comfort and/or decreases the risk of exceeding the value set by regulation.

Of course, it is possible to modify the junction between the adjacent entrance dioptric interfaces and/or between the adjacent exit dioptric interfaces differently.

For example, in the configuration mentioned by way of example with reference to FIG. 8, instead of having graining zones, a reflective, absorbent and/or scattering coating could be applied to the junction between the adjacent entrance dioptric interfaces.

The coating may partially occupy the total area of the walls forming the junction. It may be positioned in locations that are on the path of propagation of the parasitic light rays, in particular on the wall of the bottom, on the lateral walls and close to the entrance dioptric interfaces. For example, the coating may be positioned in the same locations as the graining zones 71, 72 of the example described above.

In the case of a reflective coating, the latter may be applied to all the lateral walls, or even also to the bottom of the gaps.

The invention claimed is:

1. Single-piece optical vehicle part comprising:

a plurality of optical waveguides each having an entrance dioptric and an exit dioptric interface;

at least one junction located along an optical path of one of said optical waveguides between two adjacent entrance dioptric interfaces and/or between two adjacent exit dioptric interfaces; and the single-piece optical part, wherein the junction between two adjacent entrance dioptric interfaces and/or between two adjacent exit dioptric interfaces has at least one structural modification to a surface of the single-piece optical part allowing light to be absorbed and/or scattered.

2. Single-piece optical part according to claim 1, wherein only the junctions between the adjacent entrance dioptric interfaces have the structural modification.

3. Single-piece optical part according to claim 2, wherein the one or more junctions between two dioptric interfaces forms a line of separation of said dioptric interfaces, the structural modification being arranged along this line of separation.

4. Single-piece optical part according to claim 2, wherein the entrance dioptric interfaces and/or the exit dioptric interfaces are spaced apart from one another so that a gap separates the adjacent entrance dioptric interfaces and/or the adjacent exit dioptric interfaces, the gap comprising walls that together form the junction between the dioptric interfaces that it separates.

5. Single-piece optical part according to claim 2, wherein the structural modification is blackened area produced by laser.

6. Single-piece optical part according to claim 1, wherein only the junctions between the adjacent exit dioptric interfaces have the structural modification.

7. Single-piece optical part according to claim 1, wherein the one or more junctions between two dioptric interfaces forms a line of separation of said dioptric interfaces, the structural modification being arranged along this line of separation.

8. Single-piece optical part according to claim 7, wherein the structural modification, arranged along the line of separation, extends depthwise into material of the optical part.

9. Single-piece optical part according to claim 1, wherein the entrance dioptric interfaces and/or the exit dioptric interfaces are spaced apart from one another so that a gap separates the adjacent entrance dioptric interfaces and/or the adjacent exit dioptric interfaces, the gap comprising walls that together form the junction between the dioptric interfaces that it separates.

10. Single-piece optical part according to claim 9, at least one structural modification is produced in the gap between the adjacent entrance dioptric interfaces and/or between the adjacent exit dioptric interfaces, and in that the structural modification is located at a bottom of the gap.

11. Single-piece optical part according to claim 10, wherein at least one structural modification is produced in the gap between the adjacent entrance dioptric interfaces, and in that the structural modification is located as close as possible to the adjacent entrance dioptric interfaces.

12. Single-piece optical part according to claim 10, wherein the junction between two adjacent entrance dioptric interfaces and/or the junction between two adjacent exit dioptric interfaces has a total area, called the total junction area, and in that the structural modification partially occupies the total area of the junction in question.

13. Single-piece optical part according to claim 10, wherein the structural modification is a roughened area produced by graining.

14. Single-piece optical part according to claim 9, wherein at least one structural modification is produced in the gap between the adjacent entrance dioptric interfaces, and in that the structural modification is located as close as possible to the adjacent entrance dioptric interfaces.

15. Single-piece optical part according to claim 9, wherein the junction between two adjacent entrance dioptric interfaces and/or the junction between two adjacent exit dioptric interfaces has a total area, called the total junction area, and in that the structural modification partially occupies the total area of the junction in question.

16. Single-piece optical part according to claim 9, wherein the structural modification is a roughened area produced by graining.

17. Single-piece optical part according to claim 9, wherein the structural modification comprises a reflective, absorbent and/or scattering coating.

18. Single-piece optical part according to claim 1, wherein the structural modification is a blackened area produced by laser.

19. Single-piece optical vehicle part comprising:

a plurality of entrance dioptric interfaces and/or a plurality of exit dioptric interfaces;

at least one junction between two adjacent entrance dioptric interfaces and/or at least one junction between two adjacent exit dioptric interfaces;

the single-piece optical part, wherein:

the junction between two adjacent entrance dioptric interfaces and/or the junction between two adjacent exit dioptric interfaces has at least one structural modification allowing light to be absorbed and/or scattered, the entrance dioptric interfaces and/or the exit dioptric interfaces are spaced apart from one another so that a gap separates the adjacent entrance dioptric interfaces and/or the adjacent exit dioptric interfaces, the gap comprising walls that together form the junction between the dioptric interfaces that it separates, at least one structural modification is produced in the gap between the adjacent exit dioptric interfaces, and the structural modification is located as close as possible to the adjacent exit dioptric interfaces.

20. Single-piece optical vehicle part comprising:

a plurality of entrance dioptric interfaces and/or a plurality of exit dioptric interfaces;

at least one junction between two adjacent entrance dioptric interfaces and/or at least one junction between two adjacent exit dioptric interfaces;

the single-piece optical part, wherein:

the junction between two adjacent entrance dioptric interfaces and/or the junction between two adjacent exit dioptric interfaces has at least one structural modification allowing light to be absorbed and/or scattered, the entrance dioptric interfaces and/or the exit dioptric interfaces are spaced apart from one another so that a gap separates the adjacent entrance dioptric interfaces and/or the adjacent exit dioptric interfaces, the gap comprising walls that together form the junction between the dioptric interfaces that it separates, at least one structural modification is produced in the gap between the adjacent entrance dioptric interfaces and/or between the adjacent exit dioptric interfaces, and the structural modification is located at a bottom of the gap, and at least one structural modification is produced in the gap between the adjacent exit dioptric interfaces, and that the structural modification is located as close as possible to the adjacent exit dioptric interfaces.

* * * * *